United States Patent [19]

Baeg

[11] Patent Number: 4,968,154

[45] Date of Patent: Nov. 6, 1990

[54] 4-CHANNEL SURROUND SOUND GENERATOR

[75] Inventor: Dong-Cheol Baeg, Suwon, Rep. of Korea

[73] Assignee: SamSung Electronics Co., Ltd., Suwon, Rep. of Korea

[21] Appl. No.: 414,277

[22] Filed: Sep. 29, 1989

[30] Foreign Application Priority Data

Dec. 7, 1988 [KR] Rep. of Korea ..... 1988-16271

[51] Int. Cl.[5] ..... H04S 5/00

[52] U.S. Cl. ..... 381/18

[58] Field of Search ..... 381/1, 17, 18, 19, 21, 381/23, 24

[56] References Cited

U.S. PATENT DOCUMENTS 4,410,761 10/1983 Schickedanz ..... 381/24

4,799,260 1/1989 Mandell et al. ..... 381/22

4,807,217 2/1989 Ide ..... 381/22

*Primary Examiner*—Forester W. Isen

*Attorney, Agent, or Firm*—Robert E. Bushnell

[57] ABSTRACT

Disclose is a four-channel surround-sound generator capable of generating a first surround-sound in phase to a basic channel reproduction sound and a second surround-sound out of phase thereto, by employing a channel-switching control circuit and a channel-sound delaying circuit. Said generator has a first-channel sound reproduction means and a second-channel sound reproduction means, each reproducing a respective channel-sound through a speaker, and further includes a third-channel amplifier and a fourth-channel amplifier for amplifying said each received sound to a signal level adequate to a first surround speaker and a second surround speaker, respectively, surround mode selection means for, in response to a first mode selection control signal, enabling or disabling to filter said received first-channel and second-channel sounds with a given bandwidth, surround-sound output control means for selectively enabling or disabling to make delay of the filtered first-channel and second-channel sounds supplied from the surround mode selection means, in response to a second mode selection control signal, and means for buffering control signals applied from a microcomputer, to provide said surround mode selection means with said first mode selection control signal and/or said surround-sound output control means with said second mode selection control signal.

3 Claims, 3 Drawing Sheets

4-CHANNEL SURROUND SOUND GENERATOR

BACKGROUND OF THE INVENTION

This invention relates to a so-called surround-sound generator in a stereophonic audio reproduction system and in more particular a four-channel surround-sound generator employing a delaying circuit.

There have been made many developments in the surround-sound generation technology that gives more satisfactory stereophonic sound effect to a listener than a conventional two-channel stereophonic sound. In a conventional stereophonic sound reproducing system, there are employed two separate speakers, for example, a first speaker for outputting a first channel sound and a second speaker for outputting a second channel sound in the stereophonic system, the first speaker being disposed at left or right direction to the listener and the second speaker being disposed at the opposite direction thereto. However, since the location of the speakers is conventionally fixed at a predetermined position, the listener may be unable to enjoy a perfect stereophonic sound reproduced from the speakers depending upon his location against the speakers. To solve such a drawback, one of various prior arts for surround-sound generators has been employed with the construction as illustrated in FIG. 1, which is comprised of first and second buffers (1,2), first and second amplifiers (3,4), first- and second-channel main speakers (SPL, SPR), and first- and second-channel surround speakers (SSPL, SSPR). In this construction, the effect of surround-sound comes from arranging the first and second surround-sound speakers at a direction and location different from the first and second main speakers. However, since the construction is just a parallel connection of the first-channel main speaker SPL and surround speaker SSPL and the second-channel main speaker SPR and surround speaker SSPR, the reproduced sound in each channel speaker is substantially identical and further only the direction of sound outputting is different depending on the location of the speakers used. Consequently, more satisfactory effect of surround sound in a stereophonic audio system has been very difficult to attain to its listener.

SUMMARY OF THE INVENTION

It is, therefore, an object of the invention to provide a four-channel surround-sound generator capable of generating a first surround-sound in phase to a basic channel reproduction sound and a second surround-sound out of phase thereto, by employing a channel-switching control circuit and a channel-sound delaying circuit.

According to one aspect of the present invention, the four-channel surround-sound generator having a first-channel sound reproduction means and a second-channel sound reproduction means, each reproducing a respective channel-sound through a speaker, comprises: a third-channel amplifier and a fourth-channel amplifier, respectively, receiving the first-channel and second-channel sounds for amplifying said each received sound to a signal level adequate to a first surround speaker and a second surround speaker, respectively; surround mode selection means, receiving the first-channel sound and the second-channel sound from said each reproduction means, and in response to inputting of a first mode selection control signal, enabling or disabling to filter said received first-channel and second-channel sounds with a given bandwidth; surround-sound output control means, coupled between said surround mode selection means and said third-channel and fourth-channel amplifiers, for selectively enabling or disabling to make delay of the filtered first-channel and second-channel sounds supplied from the surround mode selection means, in response to inputting of a second mode selection control signal, upon delivering to said third-channel and fourth-channel amplifiers said filtered first-channel and second-channel sounds; and means for buffering control signals applied from a microcomputer, to provide said surround mode selection means with said first mode selection control signal and/or said surround-sound output control means with said second mode selection control signal.

BRIEF DESCRIPTION OF THE DRAWINGS

For a better understanding of the invention and to show how the same may be carried into effect, reference will now be made, by way of example, to the accompanying diagrammatic drawings, in which.

DETAILED DESCRIPTION OF THE PREFERRED EMBODIMENT

Figure 1:
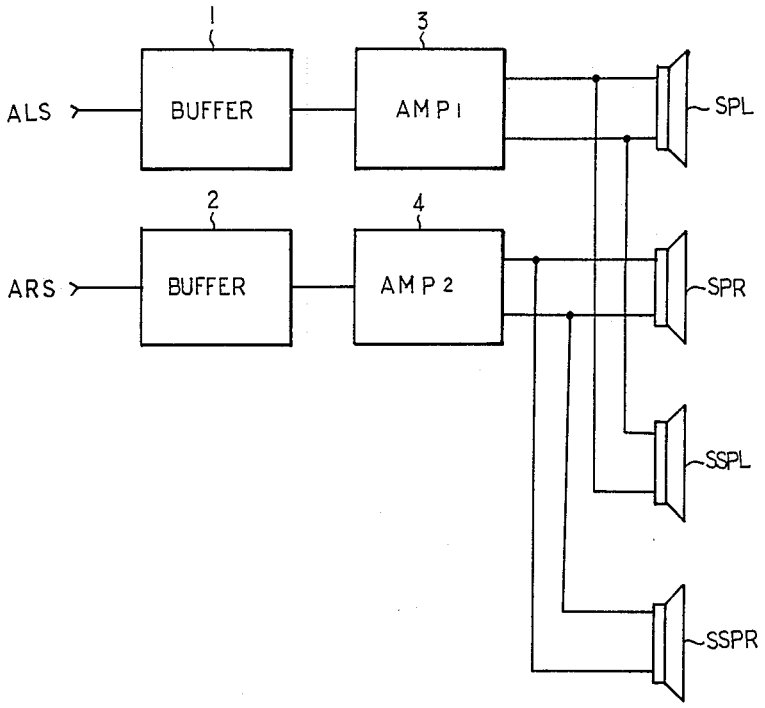
FIG. 1 PRIOR ART
FIG. 1 is a schematic block diagram showing a prior art.
Figure 2:
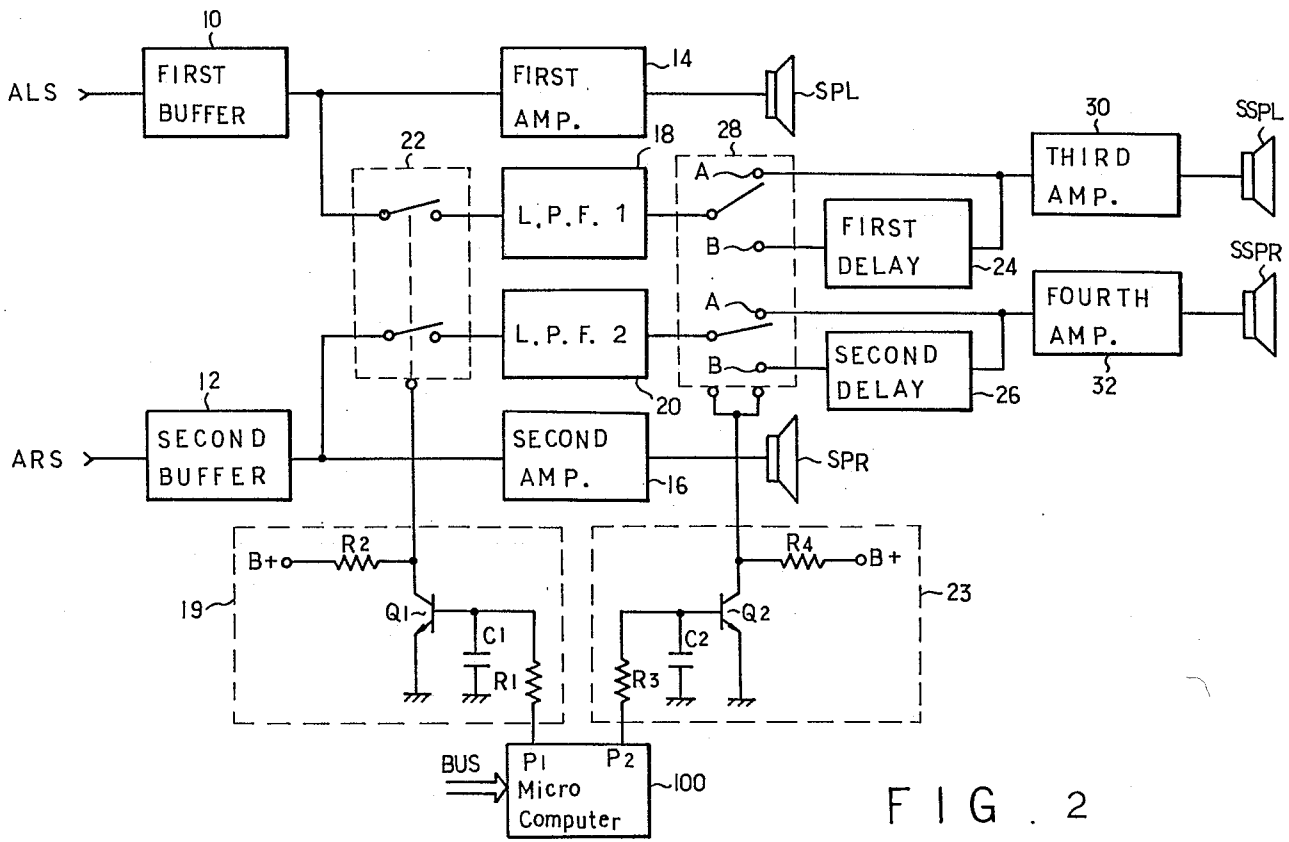
FIG. 2 is a circuit diagram according to a preferred embodiment of the present invention.
Figure 3:
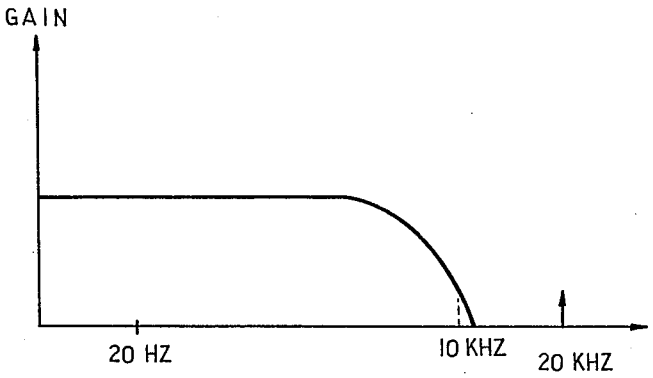
FIG. 3 is a schematic diagram showing the characteristics of a lowpass filter of the FIG. 2.

Referring to the FIG. 2, the four-channel surround-sound generator according to the invention includes first and second buffers 10, 12 for buffering first and second channel signals ALS and ARS, respectively. First and second amplifiers 14, 16 each amplify outputs of the first and second buffers, which are respectively inputted into first and second speakers SPL, SPR. First and second lowpass filters 18, 20 each have given bandpass width and receive the outputs of the first and second buffers 10, 12 through a first analog switch 22, in which the outputs of the first and second buffers are each switched to ON or OFF by a surround mode control signal and then applied to the lowpass filters 18, 20. Resistors R1, R2, capacitor C1 and transistor Q1 construct a first interfacing means of inverting buffer function, which buffers the surround mode control signal applied from a microcomputer 100 and delivers this control signal into control input of the first analog switch 22. Third and fourth amplifiers 30, 32 each receive the outputs of the lowpass filters 18, 20 through a second analog switch 28 and are coupled to first and second surround-sound speakers SSPL, SSPR. The outputs of the lowpass filters are selectively delayed through first and second delaying circuits 24, 26 before inputting to the third and fourth amplifiers 30, 32. The second analog switch 28 has two inputs for the first and second lowpass filter and selectively switches the outputs to either said third and fourth amplifiers or said first and second delaying circuits, in response to a switching control signal. Resistors R3, R4, capacitor C2 and transistor Q2 construct a second interfacing means of inverting buffer, which buffers the switching control signal applied from the microcomputer 100 to the control inputs of the second analog switch 28. The microprocessor controls all the operation of the stereophonic audio reproduction system and provides a normal-surround-mode control signal and also first- and second-surround-mode control signals into bases of the transistors Q1, Q2 through resistors R1, R3, respectively. The lowpass filters have 10-KHz bandpass characteristics, as shown through the FIG. 3.

At first, assuming that the outputs P1, P2 of the microcomputer 100 are all at logic low state, and the first analog switch 22 is open and the second analog switch 28 is switched to output terminals A, the normal and first surround mode will be explained. When the first channel sound ALS and the second channel sound ARS, for example, both left-channel and right-channel sound signals are each inputted to the first and second buffers, they are buffered therein and delivered to the first and second amplifiers 14, 16. The first and second main speakers SPL, SPR each receive the outputs of the amplifiers 14, 16 amplified with a given gain and therefrom reproduce first- and second-channel sounds, respectively. At this time, as the first analog switch 22 is open, there are no outputs from the first and second surround speakers SSPL, SSPR. This mode of operation is designated the Normal mode.

Thereafter, when the microcomputer 100 receives a surround selection control data through its bus, it analyze the data received and then provides the port P1 with logic high output turns ON the transistor Q1 and thereby a logic low signal is applied to the control input of the first analog switch 22 so as to make ON the same switch. By this operation the outputs of the first and second buffers 10,12 are each applied to the lowpass filters 18, 20 as well as to the first and second amplifiers 14, 16, through the first analog switch. Since the lowpass filters have a bandpass characteristics as shown in the FIG. 3, only a signal below 10-KHz band is filtered there through out of the first- and second-channel sound signals ALS, ARS received, to the second analog switch 28, then the outputs of the lowpass filters each are delivered to the third and fourth amplifiers 30, 32, through the ports A selected of second analog switch, further to the first and second surround-sound speakers SSPL, SSPR. Here, it will be noted that the respective sounds reproduced through these first and second surround-sound speakers are same in its phase as those reproduced through the first and second main speakers SPL, SPR, but they are not same in its frequency, to each other, since the surround-sound signals have passed the lowpass filters.

When to the microcomputer are inputted control data for a surround selection and a second mode selection, it controls to provide a logic high surround selection signal and a second surround mode control signal through the output ports P1, P2. Thus, the second analog switch 22 turns ON by the transistor Q2 also turned ON, and thereby its switch selection is transferred from position A to position B. Hence, the second analog switch connects the first and second channel sounds, that are, the outputs of the lowpass filters 10, 20 to the first and second delaying circuits 24, 26, which each have the signal delaying time of about 1 to 30 msec before delivering to the third and fourth amplifiers. Therefore, it will be noted that the first and second surround speakers SSPL, SSPR provide the listeners with sounds delayed by a given time from the first- and second-channel sound signals. That is, the original first- and second-channel sound signals ALS, ARS are reproduced without any changes, while the surround-sound signals through the speakers SSPL, SSPR are reproduced with a given time of delaying operation. This will give four-channel sound effect to the listeners of the stereophonic reproduction system, therefore providing more satisfaction in feeling the stereophonic sound. Furthermore, this effect will be able to achieve with ease by using the construction such as analog switches, lowpass filters, and delaying circuits.

While the invention has been particularly shown and described with reference to a preferred embodiment, it will be understood by those skilled in the art that modifications in detail may be made without departing from the spirit and scope of the invention. For example, other various switching circuits may be used instead of the microcomputer to generate the mode selection control signals used according to the invention.

What is claimed is:

1. In a four-channel surround sound generating circuit having a first-channel sound reproduction means and a second-channel sound reproduction means, each reproducing a respective channel-sound through a speaker, said circuit comprising:

a third-channel amplifier and a fourth-channel amplifier, respectively, receiving the first-channel and second-channel sounds for amplifying said each received sound to a signal level adequate to a first surround speaker and a second surround speaker, respectively;

surround mode selection means, receiving the first-channel sound and the second-channel sound from said each reproduction means, and in response to inputting of a first mode selection control signal, enabling or disabling to filter said received first-channel and second-channel sounds with a given bandwidth;

surround-sound output control means, coupled between said surround mode selection means and said third-channel and fourth-channel amplifiers, for selectively enabling or disabling to make delay of the filtered first-channel and second-channel sounds supplied from the surround mode selection means, in response to inputting of a second mode selection control signal, upon delivering to said third-channel and fourth-channel amplifiers said filtered first-channel and second-channel sounds; and means for buffering control signals applied from a microcomputer, to provide said surround mode selection means with said first mode selection control signal and/or said surround-sound output control means with said second mode selection control signal.

2. The circuit as set forth in claim 1, wherein said surround mode selection means comprises first and second lowpass filters for filtering said received first-channel and second-channel sounds with a given bandwidth, and a first analog switch for enabling or disabling to provide said first and second lowpass filters with said first-channel and second-channel sounds, in response to said first mode selection control signal.

3. The circuit as set forth in claim 2, wherein said surround-sound output control means comprises first and second delaying circuits for respectively delaying by a given time period said first-channel and second-channel sounds supplied from said lowpass filters to said third-channel and fourth-channel amplifiers, and a second analog switch receiving the outputs of said lowpass filters, for selectively providing said third-channel and fourth-channel amplifiers, or, said first and second delaying circuits with said first-channel and second-channel sounds from said lowpass filters.

* * * * *